US005348229A

United States Patent [19]

Wood et al.

[11] Patent Number: 5,348,229

[45] Date of Patent: Sep. 20, 1994

[54] FUEL INJECTOR LOW MASS VALVE BODY

[75] Inventors: Ross W. Wood, Yorktown; Gregory R. Stanfield, Charles City, both of Va.

[73] Assignee: Siemens Automotive L.P., Auburn Hills, Mich.

[21] Appl. No.: 46,822

[22] Filed: Apr. 13, 1993

[51] Int. Cl.[5] ..... F02M 53/04

[52] U.S. Cl. ..... 239/397.5; 239/132; 239/585.1; 239/DIG. 19

[58] Field of Search ..... 239/128, 132–132.3, 239/397.5, 585.1–585.5, DIG. 19; 251/129.21

[56] References Cited

U.S. PATENT DOCUMENTS

| | | | |
|---|---|---|---|
| 4,266,729 | 5/1981 | Kulke et al. | 239/DIG. 19 |
| 4,296,887 | 10/1981 | Hofmann | 239/397.5 |
| 4,502,196 | 3/1985 | Kupper et al. | 239/397.5 |
| 4,589,596 | 5/1986 | Stumpp et al. | 239/397.5 |
| 4,817,873 | 4/1989 | McKay | 239/132.1 |
| 4,925,111 | 5/1990 | Foertsch et al. | 239/585.1 |

FOREIGN PATENT DOCUMENTS

| | | | |
|---|---|---|---|
| 70925 | 2/1983 | European Pat. Off. | 239/132 |
| 3404709 | 8/1985 | Fed. Rep. of Germany | 239/397.5 |

*Primary Examiner*—Karen B. Merritt

*Attorney, Agent, or Firm*—George L. Boller; Russel C. Wells

[57] ABSTRACT

A composite valve body of a fuel injector comprises a dead air space for improving hot fuel handling performance. This space is cooperatively defined by a circumferential groove in the O.D. of a metal valve body and a nylon sleeve that is pressed onto the metal valve body to enclose the groove.

8 Claims, 2 Drawing Sheets

FUEL INJECTOR LOW MASS VALVE BODY

FIELD OF THE INVENTION

This invention relates to electrically actuated fuel injectors of the type used to inject gasoline or other like fuel into an internal combustion engine.

BACKGROUND AND SUMMARY OF THE INVENTION

From U.S. Pat. Nos. 3,244,377 and 4,266,729 it is known to dispose a plastic coating or sleeve over the outside of a metal valve body of a fuel injector. The former patent discloses a tetrafluoroethylene coating applied by spraying. A stated purpose of the coating is to prevent misalignment caused by removal of the nozzle from the cylinder head bore. It is also said to resist adherence of carbonaceous exhaust products. The latter patent discloses a protective sleeve made of plastic or a heat-shielding material and press-fit onto the body. The O.D. of the body has a shallow circular groove that is covered by the sleeve.

While the present invention relates to the disposition of a poorly thermally conductive sleeve on the outside of a metal valve body of a fuel injector in covering relation to a groove that extends circumferentially around the O.D. of the valve body, principles of the invention are conceptually different from the disclosures of the above-discussed patents.

The present invention relates to improving the so-called "hot fuel handling" performance of a top-feed fuel injector for a liquid-fueled, spark-ignited internal combustion engine. A known top-feed fuel injector comprises a metal valve body that is shaped to fit a certain size receptacle when installed on an engine. It has been observed that this metal body has a mass which possesses a certain thermal capacitance. Under certain conditions, this thermal capacitance delivers thermal energy to liquid fuel within the fuel injector. By limiting thermal energy transfer to liquid fuel within the fuel injector, the risk that the fuel will change phase before it is injected from the fuel injector is also limited. Vaporization of liquid fuel within the fuel injector is undesirable because it impairs the metering accuracy of an injection pulse.

According to principles of the invention, the thermal capacitance of the metal valve body is reduced by a selective reduction in the thickness of its sidewall, accompanied by the use of a poor thermal conductor in replacement of the removed material so that the shape and displacement volume of the resulting composite valve body remains the same as in the one-piece all metal valve body. Importantly, the replacement material does not merely fill the void created by the removed metal. Rather, the replacement material is a sleeve that in cooperation with the reduced thickness sidewall of the metal valve body defines a totally enclosed, poorly thermally conductive space extending circumferentially around the composite valve body. A suitable material for the sleeve is a dimensionally stable nylon that possesses acceptable characteristics for automobile engine applications, and the enclosed space is a dead air space that is an even better (perhaps as much as seven or eight times better) thermal insulator than nylon. The creation of a dead air space lowers the thermal capacitance of the composite valve body even more than replacing the entirety of the removed metal with all nylon, and this means that less nylon has to be used. Accordingly, the incorporation of a dead air space offers distinct and significant advantages. The composite valve body is readily fabricated by pressing a suitably shaped nylon sleeve over an all-metal body.

The foregoing, along with additional features, advantages, and benefits of the invention will be seen in the ensuing description and claims which are accompanied by drawings. The drawings disclose a presently preferred embodiment of the invention according to the best mode contemplated at this time for carrying out the invention.

DESCRIPTION OF THE PREFERRED EMBODIMENT

Figure 1:
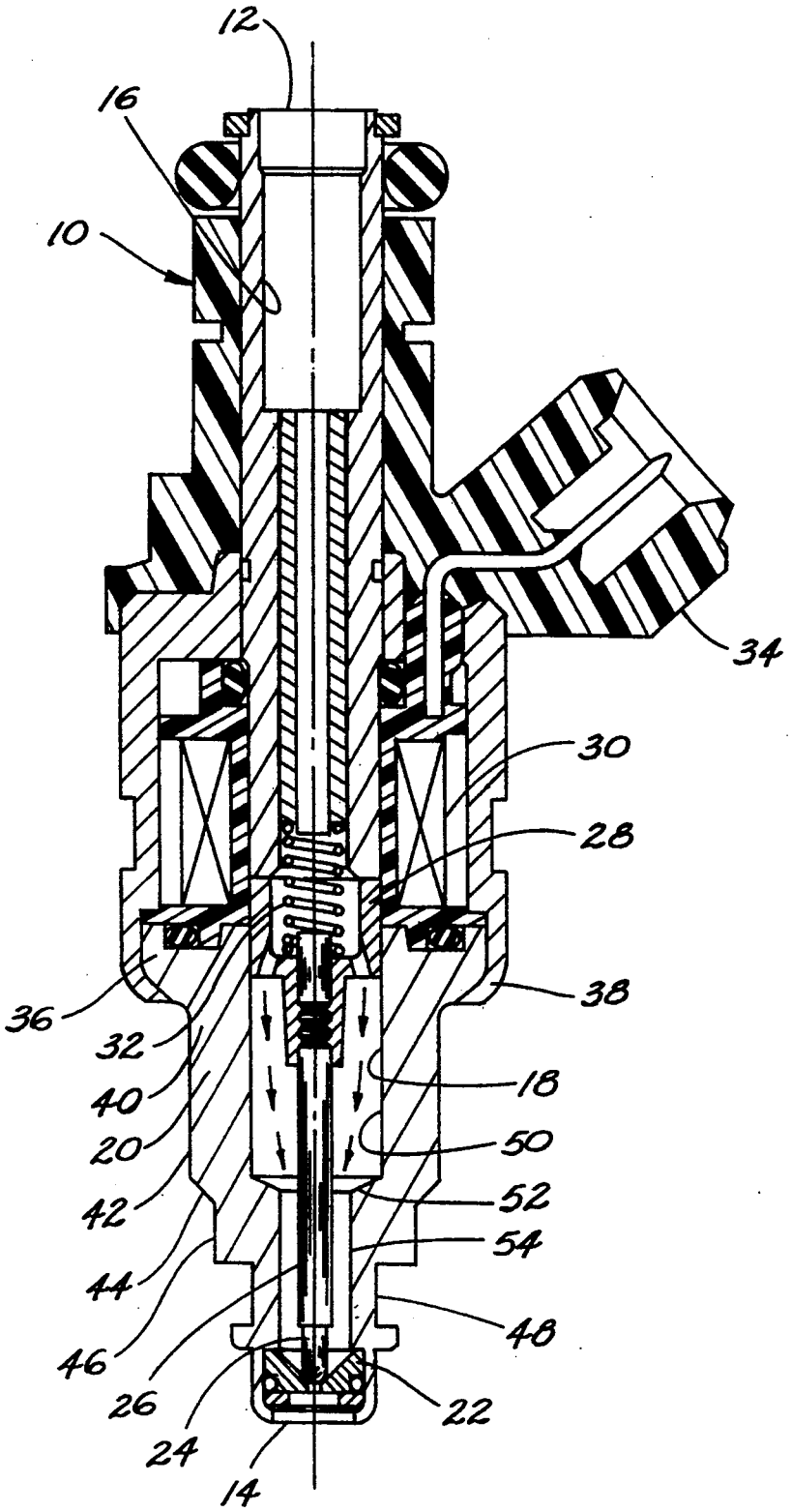
Fig. 1 PRIOR ART
FIG. 1 is a longitudinal cross sectional view of a known fuel injector.

FIG. 1 illustrates a known top-feed type solenoid-operated fuel injector 10. It comprises a top inlet 12, a bottom outlet 14, and an internal fuel passage 16 extending axially between inlet 12 and outlet 14. A portion of passage 16 that extends from outlet 14 toward inlet 12 is an axially extending through-bore 18 of a cylindrical one-piece metal valve body 20. Disposed within through-bore 18 proximate outlet 14 is a valve seat member 22 comprising a valve seat 24. A needle valve element 26 is disposed coaxially within through-bore 18 in association with valve seat 24. Needle valve element 26 is attached to an armature 28 that is associated with a solenoid 30 which is located on the fuel injector axially between valve body 24 and the top of the fuel injector. A helical spring 32 is disposed internally of the fuel injector to bias the needle valve-armature combination downwardly so that the rounded tip end of the needle valve element is seated on seat 24 to close flow through the fuel injector. Electrical terminals of the solenoid are part of a connector 34 that is on the exterior of the fuel injector for connection with a mating connector (not shown). It is via these terminals that solenoid 30 is selectively energized to open and close the flow through the fuel injector. When solenoid 30 is energized, armature 28 is attracted toward solenoid 30 lifting needle valve element 26 off seat 24 against the bias of spring 32. When solenoid 30 is not energized, spring 32 forces needle valve element 26 closed on seat 24 to stop the flow.

Valve body 20 comprises a flange 36 that is disposed against a casing 38 and over whose outer margin a lip of casing 38 is crimped. Below flange 36, valve body 20 comprises a sidewall 40 having in successive order: a straight circular cylindrical O.D. surface 42, a frusto-conically tapered surface 44, a straight circular cylindrical O.D. surface 46, and a radially outwardly open groove 48 for receiving an O-ring seal (not shown).

Along the direction from inlet 12 toward outlet 14, through-bore 18 comprises in successive order: a straight section 50, a frusto-conicaily tapered section 52, and a straight section 54. Frusto-conically tapered section 52 is disposed at substantially the same axial location along valve body 20 as frusto-conically tapered surface 44.

The known valve body is like that disclosed in commonly assigned U.S. Pat. No. 5,081,766.

Figure 3:
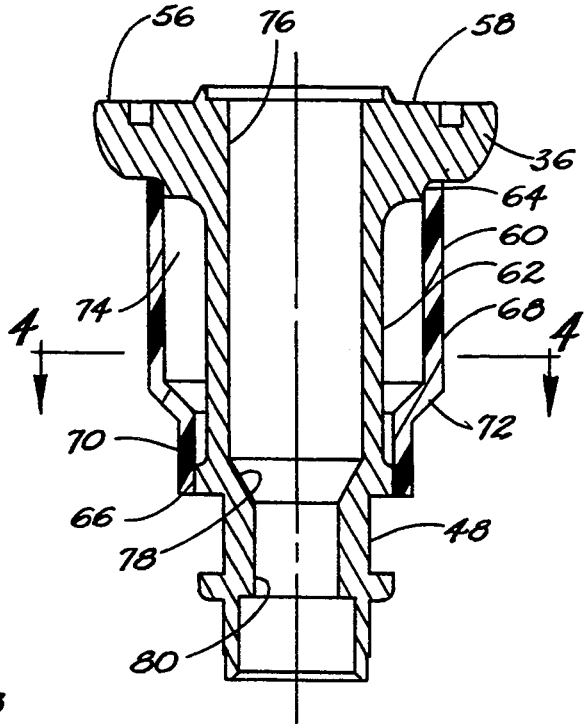
FIG. 3 is a view similar to FIG. 2, but illustrating a composite valve body according to the present invention in substitution of the one-piece all-metal valve body of FIG. 2 of a fuel injector like that of FIG. 1.
Figure 4:
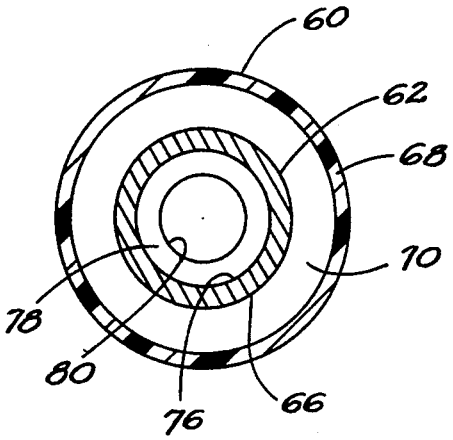
FIG. 4 is a transverse cross-sectional view in the direction of arrows 4—4 in FIG. 3.

FIGS. 3 and 4 depict a composite valve body 56 according to the invention. It comprises a one-piece all metal body 58 and a nylon sleeve 60. At its axial ends, body 58 is identical to valve body 20, comprising a flange 36 at the top and an O-ring seal groove 48 proximate outlet 14. An axially intermediate portion of body 58 is however significantly different from a corresponding axially intermediate portion of valve body 20. Between flange 36 and groove 48, body 58 has another radially outwardly open groove 62 created by removing a substantial amount of metal from around the outside of valve body 20. This leaves a short larger diameter circular cylindrical surface 64 between groove 62 and flange 36 and a short smaller diameter circular cylindrical surface 66 between groove 62 and groove 48. Surfaces 64 and 66 are coaxial, and it is onto them that opposite axial ends of sleeve 60 are pressed.

Sleeve 60 comprises a longer, larger diameter, circular cylindrical portion 68 at one axial end, a shorter, smaller diameter, circular cylindrical portion 70 at the opposite axial end, and a frusto-conically tapered portion 72 joining portions 68 and 70. The free end of portion 68 is pressed onto surface 64, and the free end of portion 70 is pressed onto surface 66. Sleeve 60 totally encloses groove 62, and cooperatively with body 58 defines a totally enclosed poorly thermally conductive space 74 that is disposed circumferentially around the composite valve body to provide thermal insulation of fuel in through-bore 18. If sleeve 60 is assembled to body 58 in air, space 74 becomes a dead air space.

It can be seen that the entire I.D. surface of portion 72 is exposed to space 74, and that the immediately contiguous I.D. surfaces of portions 68 and 70 as far as surfaces 64 and 66 are too. It can also be seen that sleeve 60 stops short of groove 48, leaving the groove unobstructed for receiving an O-ring seal. Body 58 has through-bore portions 76, 78, and 80 corresponding to portions 50, 52, and 54 of valve body 20, but portion 76 is longer than portion 50, portion 78 has a different taper from portion 52, and portion 80 is shorter than portion 54. This disposes the tapered portion closer to the outlet, substantially at the same axial location as surface 66.

Figure 2:
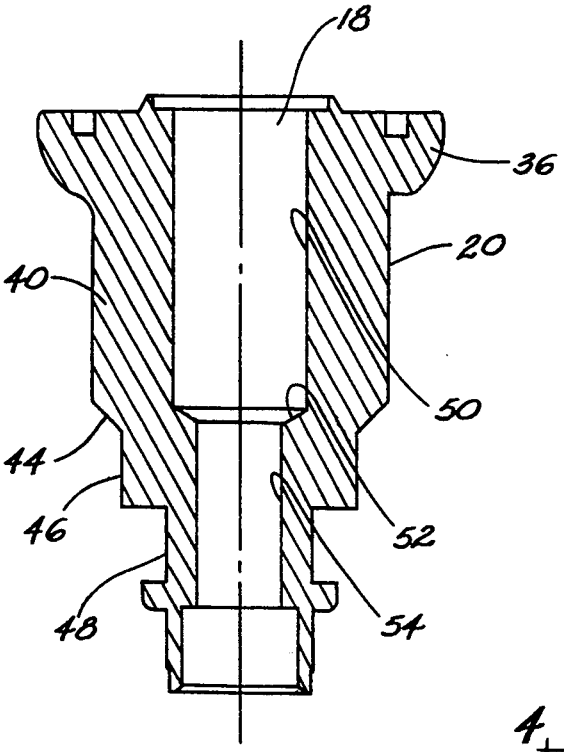
Fig. 2 PRIOR ART
FIG. 2 is an enlarged view of the one-piece all-metal valve body of the fuel injector of FIG. 1.

The replacement of denser metal by less dense media creates a significant weight savings at the same time that the hot fuel handling performance is improved. By way of example, the illustrated embodiment 58 removes about 50% of the metal from the valve body 20, and there is about a 17% weight reduction in the fuel injector. Principles of the invention are however applicable to other amounts of metal removal, and it is believed possible that meaningful benefit can be obtained even for metal removal as little as 25%. It is also to be observed that both the all-metal valve body of FIG. 2 and the composite valve body of FIG. 3 have identical volumes of identical shape such that each would displace the same volume of water if submerged in a body of water. Thus, a fuel injector containing the composite valve body of FIG. 3 may be substituted in any application requiring a fuel injector having an all metal valve body of FIG. 2. The material of sleeve 60 has sufficient strength and the wall of the sleeve has sufficient thickness to remain dimensionally stable and fitted to body 58.

While a presently preferred embodiment of the invention has been illustrated and described, principles are applicable to other embodiments. For example, principles may be applied to a brand new model of fuel injector that is not in substitution of an earlier model of fuel injector. Suitable materials other than nylon may be used.

What is claimed is:

1. An electrically operated fuel injector having a main longitudinal axis and comprising a top inlet, a bottom outlet, a fuel passage extending axially between said inlet and said outlet, a portion of said passage that extends from said outlet toward said inlet being an axially extending through-bore of a cylindrical one-piece valve body of a metal having good thermal conductivity, said through-bore containing a valve seat, a selectively operable electric actuator disposed between said valve body and the top of the fuel injector, means operatively coupling said electric actuator with a valve element that is disposed in association with said valve seat such that said valve element is caused to seat on and unseat from said valve seat in accordance with operation of said electric actuator, characterized in that said valve body comprises means defining a radially outwardly open groove in its radially outer cylindrical face, and there is also provided a tubular cylindrical, poorly thermally conductive, non-metallic sleeve fitted onto said radially outer cylindrical face of said valve body to enclose said groove and define in cooperation therewith an assembly comprising a totally enclosed, poorly thermally conductive space that is disposed circumferentially around said valve body to provide thermal insulation of fuel in said through-bore, said assembly having both a certain mass in air and a certain volume of particular shape that would displace a given volume of water if totally submerged in a body of water, said certain mass in air being at least 25% less than the mass in air of another valve body both of said metal and of said same certain volume of particular shape, and characterized further in that said sleeve comprises a smaller diameter cylindrical portion and a larger diameter cylindrical portion that are joined by a frusto-conical portion having a radially inner surface that extends between radially inner surfaces of said smaller and larger diameter cylindrical portions, said radially inner surface of said smaller diameter cylindrical portion being parallel with said main longitudinal axis, in that said larger diameter portion is disposed nearer the top of the fuel injector than is said smaller diameter portion, in that the entirety of said radially inner surface of said frusto-conical portion between said radially inner surfaces of said smaller and larger diameter cylindrical portions is exposed to said space, in that portions of said radially inner surface of said smaller and larger diameter cylindrical portions that are immediately contiguous said radially inner surface of said frusto-conical portion are also exposed to said space.

2. An electrically operated fuel injector comprising a top inlet; a bottom outlet, a fuel passage extending axially between said inlet and said outlet, a portion of said passage that extends from said outlet toward said inlet being an axially extending through-bore of a cylindrical one-piece valve body of a metal having good thermal conductivity, said through-bore containing a valve seat, a selectively operable electric actuator disposed between said and the top of the fuel injector, means operatively coupling said electric actuator with a valve element that is disposed in association with said valve seat such that said valve element is caused to seat on and unseat from said valve seat in accordance with operation of said electric actuator, characterized in that said valve body comprises means defining a radially outwardly open groove in its radially outer cylindrical face, and there is also provided a tubular cylindrical, poorly thermally conductive non-metallic sleeve fitted onto said radially outer cylindrical face of said valve body to enclose said groove and define in cooperation therewith an assembly comprising a totally enclosed, poorly thermally conductive space that is disposed circumferentially around said valve body to provide thermal insulation of fuel in said through-bore, said assembly having both a certain mass in air and certain volume of particular shape that would displace a given volume of water if totally submerged in a body of water, said certain mass in air being at least 25% less than the mass in air of another valve body both of said metal and of same certain volume of particular shape, and characterized further in that said valve body comprises means defining a second radially outwardly open groove in its radially outer cylindrical face spaced axially of said first mentioned groove in a direction toward said outlet, and in that said sleeve terminates axially short of said second groove so as to leave said second groove open to receive a seal.

3. An electrically operated fuel injector comprising a top inlet, a bottom outlet, a fuel passage extending axially between said inlet and said outlet, a portion of said passage that extends from said outlet toward said inlet being an axially extending through-bore of a cylindrical one-piece valve body of a metal having good thermal conductivity, said through-bore containing a valve seat, a selectively operable electric actuator disposed between said valve body and the top of the fuel injector, means operatively coupling said electric actuator with a valve element that is disposed in association with said valve seat such that said valve element is caused to seat on and unseat from said valve seat in accordance with operation of said electric actuator, characterized in that said valve body comprises means defining a radially outwardly open groove in its radially outer cylindrical face, and there is also provided a tubular cylindrical, poorly thermally conductive, non-metallic sleeve fitted onto said radially outer cylindrical face of said valve body to enclose said groove and define in cooperation therewith an assembly comprising a totally enclosed, poorly thermally conductive space that is disposed circumferentially around said valve body to provide thermal insulation of fuel in said through-bore, said assembly having both a certain mass in air and a certain volume of particular shape that would displace a given volume of water if totally submerged in a body of water, said certain mass in air being at least 25% less than the mass in air of another valve body both of said metal and of said same certain volume of particular shape, and characterized further in that said sleeve comprises a smaller diameter cylindrical portion and a larger diameter cylindrical portion that are joined by a frusto-conical portion having a radially inner surface that extends between radially inner surfaces of said smaller and larger diameter cylindrical portions, in that said larger diameter portion is disposed nearer the top of the fuel injector than is said smaller diameter portion, in that the entirety of said radially inner surface of said frusto-conical portion between said radially inner surfaces of said smaller and larger diameter cylindrical portions is exposed to said space, in that portions of said radially inner surface of said smaller and larger diameter cylindrical portions that are immediately contiguous said radially inner surface of said frusto-conical portion are also exposed to said space, in that said valve body comprises means defining a second radially outwardly open groove in its radially outer cylindrical face spaced axially of said first-mentioned groove in a direction toward said outlet, and in that said sleeve terminates axially short of said second groove so as to leave said second groove open to receive an O-ring seal.

4. An electrically operated fuel injector comprising a top inlet, a bottom outlet a fuel passage extending axially between said inlet and said outlet, a portion of said passage that extends from said outlet toward said inlet being an axially extending through-bore of a cylindrical one-piece valve body of a metal having good thermal conductivity, said through-bore containing a valve seat a selectively operable electric actuator disposed between said valve body and the top of the fuel injector, means operatively coupling said electric actuator with a valve element that is disposed in association with said valve seat such that said valve element is caused to seat on and unseat from said valve seat in accordance with operation of said electric actuator, characterized in that said valve body comprises means defining a radially outwardly open groove in its radially outer cylindrical face and there is also provided a tubular cylindrical, poorly thermally conductive sleeve fitted onto said radially outer cylindrical face of said valve body to enclose said groove and define in cooperation therewith an assembly comprising a totally enclosed, poorly thermally conductive space that is disposed circumferentially around said valve body to provide thermal insulation of fuel in said through-bore, said sleeve comprising a smaller diameter cylindrical portion and a larger diameter cylindrical portion that are joined by a frusto-conical portion having a radially inner surface that extends between radially inner surfaces of said smaller larger diameter cylindrical portions, and in that the entirety of said radially inner surface of said frusto-conical portion between said radially inner surfaces of said smaller and larger diameter cylindrical portions is exposed to said space and characterized further in that said valve body comprises means defining second radially outwardly open groove in its radially outer cylindrical face spaced axially of said first-mentioned groove in a direction toward said outlet, and in that said sleeve terminates axially short of said second groove so as to leave said second groove open to receive a seal assembly.

5. A fuel injector as set forth in claim 4 characterized further in that a portion of said radially inner surface of one of said smaller and larger diameter cylindrical portions that is immediately contiguous said radially inner surface of said frusto-conical portion is also exposed to said space.

6. A fuel injector as set forth in claim 4 characterized further in that said larger diameter portion is disposed nearer the top of the fuel injector than is said smaller diameter portion.

7. An electrically operated fuel injector comprising an inlet, an outlet, a fuel passage extending axially between said inlet and said outlet, a portion of said passage that extends form said outlet toward said inlet being an axially extending through-bore of a cylindrical one-piece valve body of a metal having good thermal conductivity, said through-bore containing a valve seat, a selectively operable electric actuator, means operatively coupling said electric actuator with a valve element that is disposed in association with said valve seat such that said valve element is caused to seat on and unseat from said valve seat in accordance with operation of said electric actuator, characterized in that said valve body comprises means defining a first radially outwardly open groove in its radially outer cylindrical face, and there is also provided a tubular cylindrical, poorly thermally conductive sleeve fitted onto said radially outer cylindrical face of said valve body to enclose said groove and define in cooperation therewith an assembly comprising a totally enclosed, poorly thermally conductive space that is disposed circumferentially around said valve body to provide thermal insulation of fuel in said through-bore, and in that said valve body further comprises means defining a second radially outwardly open groove in its radially outer cylindrical face spaced axially of said first-mentioned groove in a direction toward said outlet, and in that said sleeve terminates axially short of said second groove so as to leave said second groove open to receive a seal assembly.

8. A fuel injector as set forth in claim 7 characterized further in that said sleeve comprises a smaller diameter cylindrical portion and a larger diameter cylindrical portion that are joined by a frusto-conical portion having a radially inner surface that extends between radially inner surfaces of said smaller and larger diameter cylindrical portions, and in that the entirety of said radially inner surface of said frusto-conical portion between said radially inner surfaces of said smaller and larger diameter cylindrical portions is exposed to said space.

* * * * *